United States Patent [19]

Rhee

[11] Patent Number: 4,509,643

[45] Date of Patent: Apr. 9, 1985

[54] GOLF BAG WITH A REINFORCING INSERT TUBE

[76] Inventor: Yong S. Rhee, 251-1 Soo Yoo 2nd-Dong, Dohbong-ku, Seoul, Rep. of Korea, 132

[21] Appl. No.: 532,523

[22] Filed: Sep. 15, 1983

[30] Foreign Application Priority Data

Sep. 15, 1982 [KR] Rep. of Korea ..... 7279

[51] Int. Cl.[3] ..... A63B 55/00

[52] U.S. Cl. ..... 206/315.8; 206/315.3; 206/315.6; 383/119

[58] Field of Search ..... 206/315.6, 315.7, 315.8, 206/315.3, 517, 315.4, 315.5; 220/77, 80; 248/96; 383/119

[56] References Cited

U.S. PATENT DOCUMENTS

| | | | |
|---|---|---|---|
| 1,047,653 | 12/1912 | Killion | 206/517 X |
| 2,435,479 | 2/1948 | Thommen | 206/315.8 |
| 2,866,481 | 12/1958 | Bratsch | 220/77 X |
| 3,147,786 | 9/1964 | Kish, Jr. | 206/315.8 |
| 3,564,586 | 2/1971 | Legoff | 206/315.8 |
| 3,674,072 | 7/1972 | Shuto | 206/315.6 |
| 3,729,036 | 4/1973 | McFadden | 206/315.6 |
| 3,739,833 | 6/1973 | Rausch et al. | 220/80 X |
| 4,084,066 | 4/1978 | Gillemot | 220/80 X |
| 4,266,589 | 5/1981 | Cochran | 206/315.3 |
| 4,311,178 | 1/1982 | Kennedy | 206/315.6 |

*Primary Examiner*—William Price
*Assistant Examiner*—Sue A. Weaver
*Attorney, Agent, or Firm*—Fisher, Christen & Sabol

[57] ABSTRACT

A combination of a collapsible golf bag and a reinforcing insert tube. The reinforcing insert tube is a flexible sheet rolled onto itself and positioned within the golf bag such that the lower end of the tube contacts the base bottom portion of the golf bag. The upper end of the tube is tucked between a flap of the upper open rigid annular portion of the golf bag and the flexible side wall of the golf bag. In this manner, the golf bag can be expanded by inserting the reinforcing insert tube into the bag to yield a self-supporting and rigid golf bag like that of the more conventional golf bags.

5 Claims, 4 Drawing Figures

GOLF BAG WITH A REINFORCING INSERT TUBE

BACKGROUND OF THE INVENTION

1. Field of the Invention

The present invention relates to a collapsible golf bag which, when properly assembled, will be self supporting and rigid as is typical of the more conventional golf bag. The present invention also relates to a reinforcing tube which fits into a collapsible golf bag to yield the self supporting and rigid characteristics.

2. Description of the Prior Art

Conventional golf bags are extremely rigid and do not yield or collapse, making the bag difficult to handle, transport, and store. In particular, with the advent of the small automobile, rigid golf bags do not fit into the smaller luggage compartments. The problem is particularly acute when additional luggage is desired to be transported in the same compartment. For example, where four persons each having a golf bag attempt to fit their respective golf bags into the trunk of an automobile together with their luggage, the space occupied by the golf bags themselves unduly limits the amount of luggage that might otherwise be carried with ease in the luggage compartment of an automobile.

Also, with the cost of housing increasing beyond the reach of most individuals and families, there is a definite trend to make houses smaller and thus, more affordable. In making homes smaller, storage space has become a problem. Golf bags which are bulky, non-collapsible, and very rigid do not fit into the smaller storage spaces with other necessary household applicances.

In addition to the above problems, transportation of golf bags is quite expensive, primarily because transportation is based on volume, rather than weight. Because a golf bag occupies a large volume, transportation from the factory to the retailer is expensive. Furthermore, handling of a plurality of golf bags is difficult because of their bulkiness. A retailer, when restocking merchandise, often finds he cannot personally carry more than four golf bags at any one time, although the weight of the four golf bags is not excessive. Because a retailer spends more time restocking shelves, this additional cost is passed on to the consumer. Hence, the consumer golfer pays a heavy burden for the cost of handling golf bags by the retailer, and for the cost of transporting the golf bags from the manufacturer to the retailer.

SUMMARY OF THE INVENTION

The prior art problems are overcome with the golf bag of the present invention. The golf bag of the present invention is a collapsible golf bag which can be folded into a much smaller volume (approximately one-fourth) than a conventional tubular golf bag.

The golf bag can be unfolded and the reinforcing tube can be inserted yielding a rigid and self supporting golf bag. Thus, the golf bag of the present invention can be collapsed to fit within the luggage compartment of smaller automobiles, or fit within the storage compartments of smaller homes. Also, the collapsible golf bags take up much less space during transportation, making them cheaper to ship from the manufacturer to the various retail outlets. In addition thereto, the retailer can personally carry a box of collapsed golf bags to the display area of the store resulting in less time required to stock the display. Furthermore, a retailer can carry a wider variety of golf bags in inventory because less room is required when the golf bags are collapsed, as compared with conventional golf bags.

It is an object of this invention to provide a novel golf bag which will be cheaper than prior conventional golf bags.

It is another object of this invention to provide a novel golf bag which is easily assembled at any place, such as at home, at the golf course, or in the retail stores.

It is another object of this invention to considerably reduce the transportation cost of the golf bags.

These and other objects and advantages of the invention will become apparent from the following description made with reference to the preferred embodiment of the invention in the accompanying drawings and from the claims.

DESCRIPTION OF THE PREFERRED EMBODIMENTS

Figure 1:
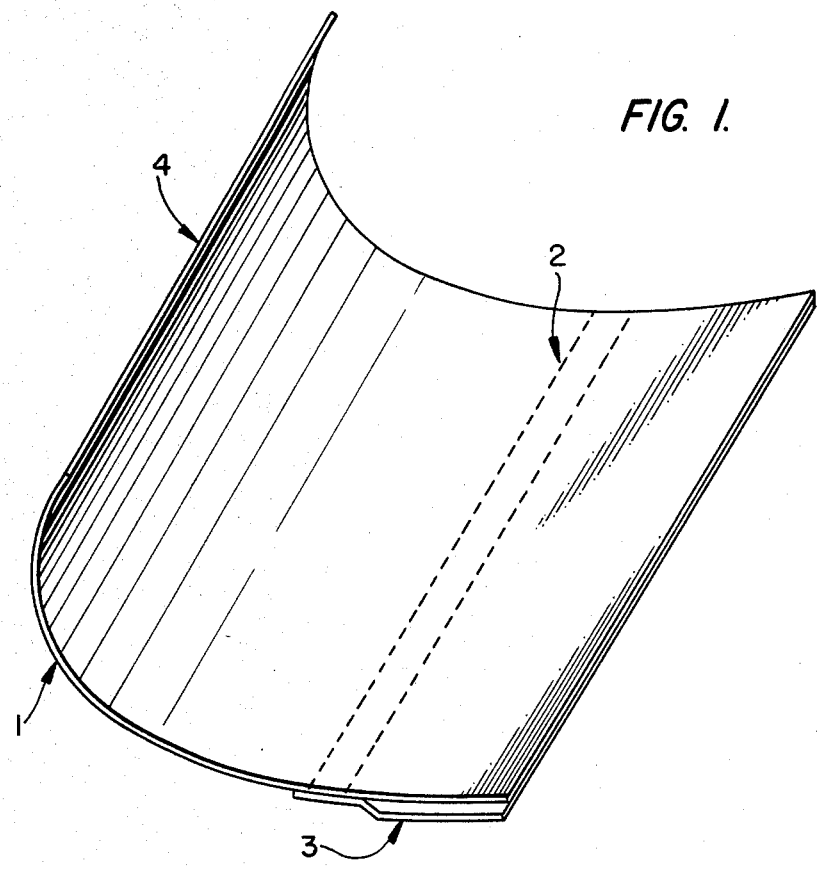
FIG. 1 shows a flexible reinforcing insert sheet.

The reinforcing insert tube of the present invention is formed from the flexible insert sheet as shown in FIG. 1. The flexible sheet 1 comprises an additional overlapping portion 3 attached to sheet 1 as indicated by reference Numeral 2. The flexible sheet can be formed from plastic or sheet metal. The additional overlapping portion 3 is preferably formed of the same material as the flexible insert sheet 1. However, overlapping portion 3 can be made of any suitable material. In the area where overlapping portion 3 is attached to the flexible insert sheet 1, the sheet and overlapping portion can be sewn together, welded together, glued together, riveted together, or any other suitable attachment means can be employed.

Figure 2:
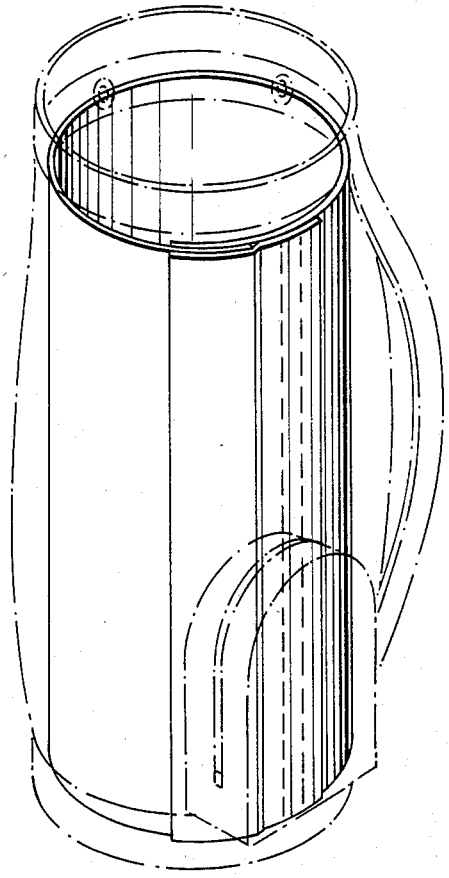
FIG. 2 shows the reinforcing insert sheet rolled into a tube with the golf bag shown in phantom.
Figure 3:
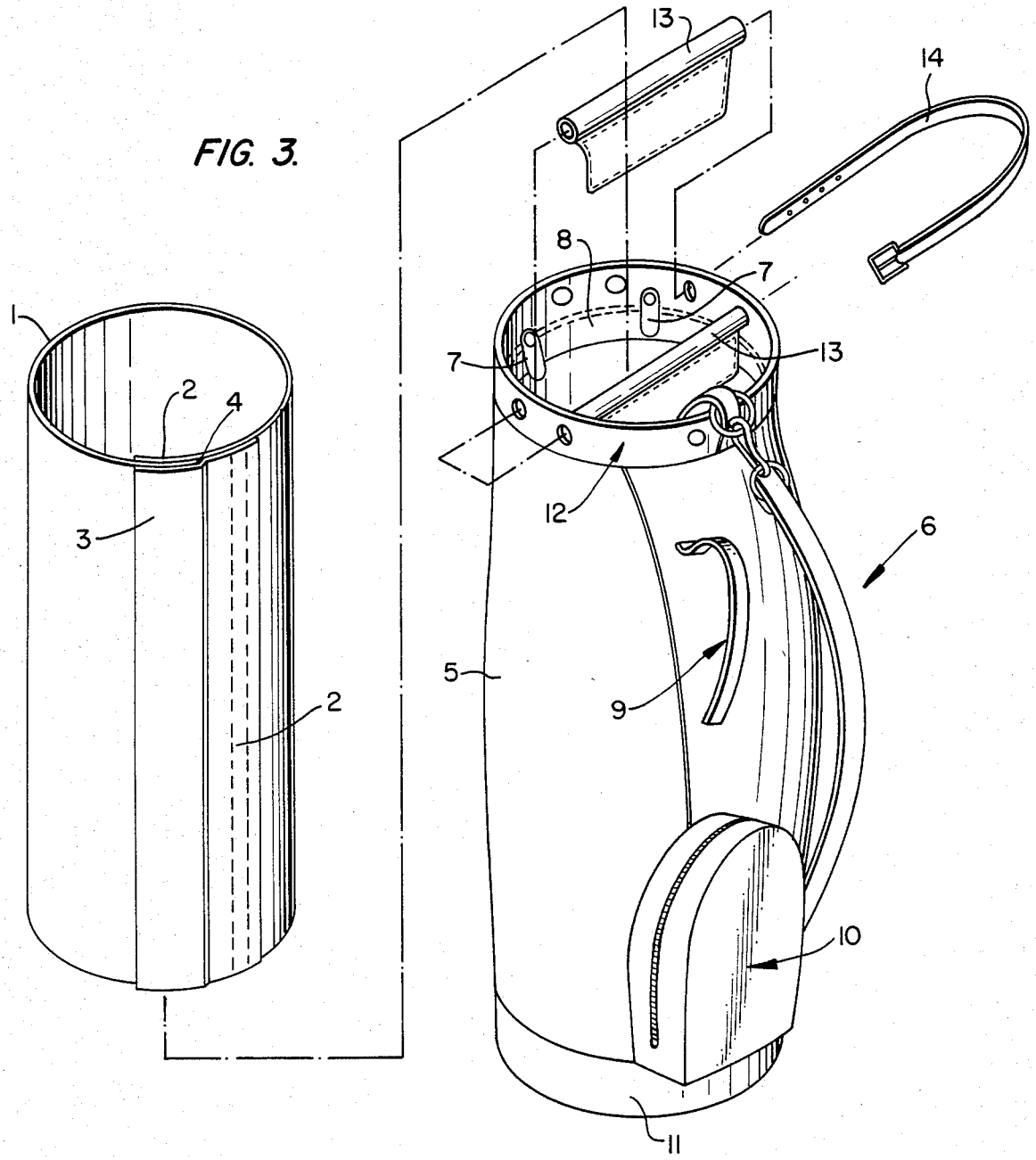
FIG. 3 shows the method of assembling the reinforcing insert tube into the golf bag.

The flexible reinforcing insert sheet 1 is then rolled upon itself and edge 4 is inserted between the flexible sheet 1 and the overlapping portion 3 to form a tube as shown in FIGS. 2 and 3. Once the sheet is rolled into a tube, the tube will not further collapse to a smaller diameter, because edge 4 is held in a stationary position between the sheet and the overlapping portion.

As shown in FIG. 2, the insert tube is then inserted into a golf bag to provide the normally flexible walls with sufficient strength to yield a self-supporting and rigid golf bag of the more conventional type.

FIG. 3 shows a golf bag which comprises an upper open rigid annular portion 12 and a lower rigid solid bottom base portion 11 with a generally flexible side wall 5. The golf bag also includes an exterior pouch 10, a shoulder strap 6, and a hand grip 9. The interior of the golf bag is portioned by dividers 13 which are rigidly positioned and held into place by strap 14. The upper open rigid annular portion 12 is usually made of a rigid plastic, vinyl, leather or any other suitable means. The bottom base portion 11 is generally made of rubber, plastic, vinyl or any other suitable material. The flexible wall portion 5, the exterior pouch 10, the shoulder strap 6, and the hand grip 9 can be made from vinyl, leather, any suitable fabric such as nylon, dacron, or rayon, or any moldable plastic such as polypropylene or polyethylene.

Figure 4:
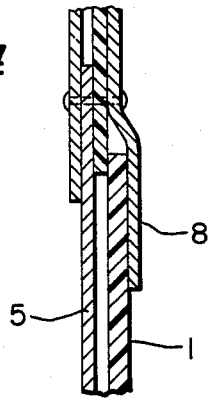
FIG. 4 shows a cross-sectional side view of the top portion of the reinforcing insert tube as it is fully assembled within the golf bag.

When assembling the golf bag, the tube is inserted into the golf bag until the lower end of the tube is in total contact with the bottom base portion 11. Then, flap portion 8 of the upper open rigid annular portion 12 is lifted such that the tube is inserted behind it, between the flap portion and the flexible wall portion 5, as shown in FIG. 4. The dividers 13 can then be positioned into place by means of strap 14.

Once the golf bag is fully assembled, it is as rigid and self-supporting as any conventional golf bag. It may be necessary however, to incorporate hold down tabs 7 which help keep flap 8 over the insert tube 1.

When it is desirable to transport a large number of the golf bags, the dividers are removed allowing the reinforcing insert tube to be removed from the golf bag by lifting flap 8 and prying the reinforcing tube from the interior of the golf bag. Then, the golf bag can be collapsed by merely rolling the solid base portion 11 onto the flexible wall portion 5, until the golf bag is completely rolled into a ball. Then the reinforcing tube can be unrolled to form a flat sheet. In transporting a plurality of golf bags, all the sheets could be laid flat in the bottom of a box, while all the rolled golf bags can be placed on top of the reinforcing sheets thus allowing a manufacturer to ship many more golf bags in a box, as compared to the more conventional golf bag. Furthermore, when the transported box reaches the retailer, he can easily carry the box to the area of the store where golf bags are being displayed and quickly assemble the bags. This saves the retailer time because he can restock his supply of golf bags in a much quicker fashion than was previously possible with the conventional golf bag. Therefore, the savings in transportation and in restocking the display time allows the retailer to market the golf bags at a more favorable price to the consumer golfer.

What I claim is:

1. A golf bag, comprising in combination:

a flexible cylinder having a bottom end and a top end;

a lower base portion fixedly connected to said bottom end of said flexible cylinder;

a rigid annular member fixedly connected to said top end of said flexible cylinder; said rigid annular member having an upper free end and a lower end;

said lower end of said rigid annular member having an inner flap and an outer portion having an inner layer; said outer portion being fixedly connected to said top end of said flexible cylinder such that said flexible cylinder is generally continuous with said rigid annular member along respective peripheries thereof so that said rigid annular member forms an opening into said flexible cylinder;

said inner flap of said rigid annular member being annular and having an upper fixed portion and a lower free portion; said upper fixed portion of said inner flap being fixedly connected to said inner layer of said outer portion of said rigid annular member at a location intermediate a lower end and an upper end of said inner layer, such that a receiving portion exists between said inner layer and said inner flap of said rigid annular member; said receiving portion being adapted to receive an edge of a curved sheet;

an assembleable insert cylinder including a resiliently bendable sheet; said resiliently bendable sheet having generally a rectangular perimeter and further having an elongated, resiliently bendable member fixedly connected thereto generally parallel to an edge of said resiliently bendable sheet at a location spaced a predetermined distance from said edge of said resiliently bendable sheet; said elongated, resiliently bendable member having an extension portion which extends generally parallel to said resiliently bendable sheet toward said edge of said resiliently bendable sheet; said extension portion and said edge being adapted to receive an opposing edge of said resiliently bendable sheet therebetween;

in assembled condition, with said opposing edge of said resiliently bendable sheet inserted between said extension portion and said edge to form a cylinder, said assembleable insert cylinder being insertable into said flexible cylinder through said rigid annular member, said assembleable insert cylinder having a length sufficient to contact both said lower base portion of said flexible cylinder and a portion of said inner flap when said flexible cylinder is fully extended about said assembleable insert cylinder; said inner flap being sufficiently flexible to be moved away from said inner layer of said outer portion so as to receive an uppermost edge of said assembleable insert cylinder;

whereby said assembleable insert cylinder is retained within said flexible cylinder by said inner layer of said flexible cylinder.

2. A golf bag as claimed in claim 1, wherein said rigid annular member further comprises a hold-down means which is selectively engageable and disengageable with said inner flap to retain said inner flap in an overlying relationship to said uppermost edge of said assembleable insert cylinder;

whereby said assembleable insert cylinder is securely selectively retained by said hold-down means;

said assembleable insert cylinder being selectively removable from said flexible cylinder by disengagement of said hold-down means, and flexibly bending said inner flap so that it does not overly said assembleable insert cylinder; whereby removal of said assembleable insert cylinder through said rigid annular member is unimpeded, and remains assembleable with said flexible cylinder.

3. A golf bag as claimed in claim 2, wherein said assembleable insert cylinder is flexible plastic which is sufficiently strong to serve as a reinforcement for said flexible cylinder against collapsing when in assembled condition.

4. A golf bag as claimed in claim 2, wherein said inner flap and outer portion are fastened together by sewing.

5. A golf bag as claimed in claim 2, wherein said lower base portion is solid.

* * * * *